US007591916B2

(12) United States Patent
Kim et al.

(10) Patent No.: US 7,591,916 B2
(45) Date of Patent: Sep. 22, 2009

(54) METHOD FOR PRODUCING COMPOSITE MATERIALS COMPRISING CU-BASED AMORPHOUS ALLOY AND HIGH FUSION POINT ELEMENT AND COMPOSITE MATERIALS PRODUCED BY THE METHOD

(75) Inventors: Yu Chan Kim, Goyang-si (KR); Jae Chul Lee, Seoul (KR); Do Hyang Kim, Seoul (KR); Eric Fleury, Seoul (KR)

(73) Assignee: Korea Institute of Science & Technology, Seoul (KR)

( * ) Notice: Subject to any disclaimer, the term of this patent is extended or adjusted under 35 U.S.C. 154(b) by 102 days.

(21) Appl. No.: 11/732,011

(22) Filed: Apr. 2, 2007

(65) Prior Publication Data

US 2007/0175550 A1 Aug. 2, 2007

Related U.S. Application Data

(63) Continuation of application No. 10/640,810, filed on Aug. 14, 2003, now abandoned.

(30) Foreign Application Priority Data

Jun. 17, 2003 (KR) ..... 10-2003-39161

(51) Int. Cl.
*C22C 45/00* (2006.01)

(52) U.S. Cl. ..... 148/553; 148/561

(58) Field of Classification Search ..... None
See application file for complete search history.

(56) References Cited

U.S. PATENT DOCUMENTS 4,880,482 A * 11/1989 Hashimoto et al. ..... 148/403
6,010,580 A 1/2000 Dandliker et al.
2004/0112475 A1* 6/2004 Inoue et al. ..... 148/403

FOREIGN PATENT DOCUMENTS

| | | |
|---|---|---|
| JP | 09-020968 | 1/1997 |
| JP | 2002-256401 | 9/2002 |
| WO | 96/24702 | 8/1996 |
| WO | 02/053791 | 7/2002 |

OTHER PUBLICATIONS

Johnson, et al., "The effect of silicon on the glass forming ability of the $Cu_{47}Ti_{34}Zr_{11}Ni_8$ bulk metallic glass forming alloy during processing of composites", Journal of Applied Physics, vol. 83, No. 12, p. 7993-7997, Jun. 1998.

* cited by examiner

*Primary Examiner*—George Wyszomierski
(74) *Attorney, Agent, or Firm*—Merchant & Gould P.C.

(57) ABSTRACT

In Cu-based bulk amorphous matrix composite materials, comprising a Cu-based amorphous alloy containing high fusion point element(s) selected from a group of Ta, W or combination thereof, wherein the high fusion point element(s) has(have) a shape of crystalline grain and is(are) dispersed around a Cu-based amorphous matrix. Cu-based bulk amorphous matrix composite materials have the composition expressed as the following Chemical formula 1;

$Cu_aZr_bTi_cR_d$ [Chemical formula 1]

where R is Ta, W or combination thereof, a, b, c and d are atomic weight ratio, a+b+c+d equals 100, a, b, c, and d have the range of $45 \leqq a \leqq 65$, $10 \leqq b \leqq 35$, $5 \leqq c \leqq 30$, and $5 \leqq d \leqq 10$, respectively.

3 Claims, 5 Drawing Sheets

METHOD FOR PRODUCING COMPOSITE MATERIALS COMPRISING CU-BASED AMORPHOUS ALLOY AND HIGH FUSION POINT ELEMENT AND COMPOSITE MATERIALS PRODUCED BY THE METHOD

This Application is a Continuation of U.S. application Ser. No. 10/640810 filed on Aug. 14, 2003, which claims priority to Korean Application 10-2003-39161 filed on Jun. 17, 2003.

BACKGROUND OF THE INVENTION

1. Field of the Invention

The present invention relates to Cu-based bulk amorphous matrix composite materials and a production method thereof, and more particularly to Cu-based bulk amorphous matrix composite materials containing high fusion point elements, which considerably increase the elongation rate while minimizing the reduction of strength of the bulk amorphous materials through adding high fusion point elements, Ta and/or W, so as to control abrupt fracture behaviors of the amorphous materials, and to a production method thereof.

That is to say, the present invention relates to Cu-based bulk amorphous matrix composite materials containing high fusion point elements, in which a certain ratio of Ta or W solid solution is dispersed in a Cu-based matrix with above 90% of amorphous volumetric ratio, providing excellent mechanical properties such as strength, elongation rate and so forth, and to a production method thereof.

2. Description of the Prior Art

Recently, as in pursuing of scale-down, lightening and multifunctioning of machine parts, it has been requiring a multi functional structural metallic materials improving mechanical properties and functionibility two or more times over the existing structural materials. Bulk type amorphous metallic materials are the innovative materials to satisfy such requirements of times, so that they have been world widely studying actively. Bulk type amorphous materials in which their atomic structures becomes to be amorphous are regarded as the next-generation structural metallic materials exceeding limits of physical properties of the existing metallic materials and are estimated as strategic metallic materials the new industry of the future requires after they had been initially reported by Caltech of USA in 1993.

Among amorphous materials, zirconium-based alloy has been commercially developing as materials for sporting goods and the military. However, since the element, zirconium has a specialty in light of resources, it has been now developing various kinds of commercial alloy amorphous materials. Representative one of the commercial metallic materials, Cu-based amorphous materials have characteristics similar to the other alloy system and have a high value in economic aspects as well.

Johnson et al., USA, reported Cu-based amorphous alloy containing about 40~60 atomic weight %, and registered Patent claiming compositions including the above composition. (Refer to a document, JOURNAL OF APPLIED PHYSICS, VOL. 83, 1998, p7993, Johnson et al., WO96/24702 A1, 1996). Also, Inoue, Japanese, registered Patent claiming compositions including 40~70 atomic weight % of Cu (Inoue et al., WO02/053791 A1, 2002, Japanese Patent Application No. 2002-256401).

However, although bulk type amorphous materials (or bulk type nano composite materials) developed by present have strength and elastic limit higher than 2~4 times in comparing with the existing metallic materials, it is difficult for them to be applied to structural materials because of their abrupt fracture behaviors. Such brittleness is caused by a formation of shear bands so that it must be resolved to put them to practical use.

Typically, in order to increase toughness of materials with brittleness such as ceramics, it has been using a method for dispersing ceramic particles or ductile metallic crystalloid. Such method, however, causes a fracture phenomenon such as a crack deflection, a branching, plural shear bands, blunting and so forth during cracking.

Accordingly, the method can be adapted to bulk type amorphous materials having the similar mechanical properties to those of ceramic materials.

SUMMARY OF THE INVENTION

Accordingly, the present invention has been made to solve the above-mentioned problems occurring in the prior art, and an object of the present invention is to provide Cu-based bulk amorphous matrix composite materials containing high fusion point elements, which considerably increase the elongation rate while minimizing the reduction of strength of the bulk amorphous materials through adding high fusion point elements, Ta and/or W, so as to control abrupt fracture behaviors of the amorphous materials, and to a production method thereof.

In order to accomplish this object, there are provided Cu-based bulk amorphous matrix composite materials, comprising a Cu-based amorphous alloy containing high fusion point element(s) selected from a group of Ta, W or combination thereof, wherein the high fusion point element(s) has(have) a shape of crystalline grain and is(are) dispersed around a Cu-based amorphous matrix.

According to the present invention, the Cu-based amorphous matrix composite materials have the composition expressed as the following Chemical formula 1;

$$Cu_aZr_bTi_cR_d \qquad \text{[Chemical formula 1]}$$

where R is Ta, W or combination thereof, a, b, c and d are atomic weight ratio, a+b+c+d equals 100, a, b, c, and d have the range of $45 \leqq a \leqq 65$, $10 \leqq b \leqq 35$, $5 \leqq c \leqq 30$, and $5 \leqq d \leqq 10$, respectively.

According to the present invention, the Cu-based amorphous matrix has above 90% of amorphous volume fraction.

According to another aspect of the present invention, there is provided a method for producing Cu-based amorphous matrix composite materials containing high fusion point element, the method comprising the steps of: (a) fusing high fusion point element(s), Ta or W, in a arc-melting furnace together with matrix element(s), Cu, Zr or Ti, thus producing a binary (matrix element-high fusion point element) master alloy; (b) arc-melting the binary alloy from the step (a) together with the matrix element(s), Cu, Zr or Ti, thus producing another master alloy with target composition; (c) melting the master alloy of the step (b) in the atmosphere of Ar in a Quartz tube using a radio-frequency melting furnace;

and (d) injecting the fused metal of the step (c) into a molding die with blowing Ar gas, and solidifying the same.

According to the present invention, the composition of the master alloy in the step (c) satisfies the following Chemical formula 1;

$$Cu_aZr_bTi_cR_d \quad \text{[Chemical formula 1]}$$

where R is Ta, W or combination thereof, a, b, c and d are atomic weight ratio, a+b+c+d equals 100, a, b, c, and d have the range of $45 \leqq a \leqq 65$, $10 \leqq b \leqq 35$, $5 \leqq c \leqq 30$, and $5 \leqq d \leqq 10$, respectively.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
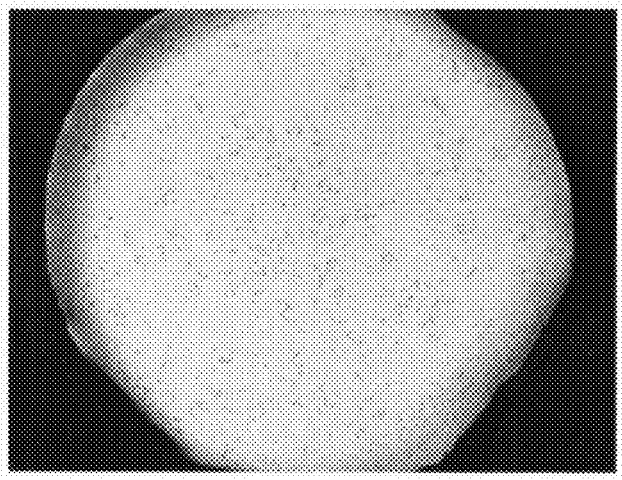
FIG. 1 is a photograph showing an end face of a specimen with 1 mm of diameter of Cu—Zr—Ti—Ta amorphous matrix composite materials produced by the present invention.

Hereinafter, preferred embodiments of the present invention will be described with reference to the accompanying drawings.

Cu-based amorphous alloy used in the present invention can be produced in a shape of homogeneous bulk by an injection molding method or a suction molding method with relative fast cooling rate.

In the present invention, in order to complement strength of Cu-based amorphous materials, high fusion point element with high strength, W is added about 3~7 atomic weight %, thus considerably improving strength and ductility as well comparing with existing Cu-based amorphous materials. Also, in order to complement ductility, high fusion point element with excellent ductility, Ta is added about 5~10 atomic weight %, thus considerably improving ductility together with strength.

In the present invention, in order to produce Cu-based amorphous matrix composite materials containing high fusion point element(s), firstly, high purity matrix element(s), Cu, Zr or Ti are fused in an arc-melting furnace together with high fusion point element(s), Ta or W, thus to produce a binary (matrix element-high fusion point element) master alloy.

Referring to an equilibrium diagram, Ti—Ta, Ti—W, Ti—Zr, Zr—Ta, Ta—W and so forth form isomophous solid solution. That is to say, in the present invention, high fusion point element(s), Ta or W is(are) melted in the arc-melting furnace together with the matrix element(s), Cu, Zr or Ti according to a target combination of an alloy forming such isomophous solid solution, producing the binary (matrix element-high fusion point element) master alloy, which reduces fusion point of an alloy.

Then, the binary (matrix element-high fusion point element) master alloy is arc-melted together with the matrix element(s), Cu, Zr or Ti, producing Cu—Zr—Ti—R (R is Ta and/or W) master alloy. The master alloy produced is then melted and cooled to produce Cu-based amorphous matrix composite materials in which a certain fraction of Ta and/or W solid solution particles are dispersed around a Cu-based matrix with above 90% of amorphous volume fraction.

Hereinafter, the composition and effect of the present invention are described in detail with reference to various examples.

Although the following examples are described as follows, the present invention is not limited to the examples.

In order to compare mechanical properties of amorphous matrix composite materials of the present invention with Cu-based amorphous materials of the prior art, rod type specimens with 1 mm of diameter according to the present invention and the prior art, respectively were produced by an injection molding method.

EXAMPLE 1

In this example, Cu—Zr—Ti—Ta amorphous matrix composite material containing high fusion point element, Ta, was produced.

First, Zr and Ta elements with above 99.9 wt % of purity were fused in an arc-melting furnace, producing an binary master alloy having a composition of $Zr_{80}Ta_{20}$. Then, the master alloy was arc-melted together with Cu, Zr and Ti, producing an alloy having a composition of $Cu_{57}Zr_{28.5}Ti_{9.5}Ta_5$. Herein, the ratio of atomic weight of Cu:Zr:Ti is 60:30:10. The master alloy produced was fused in an atmosphere of Ar gas in the quartz tube using a radio-frequency melting furnace, Ar gas was injected into a Cu mold with excellent cooling ability, producing rod specimen with 1~3 mm of diameter.

Comparison Example 1

In order to compare mechanical properties of amorphous matrix composite materials produced from example 1, Cu-based amorphous alloy of $Cu_{60}Zr_{30}Ti_{10}$ in which ratio of atomic weight of Cu:Zr:Ti is 60:30:10 was produced.

In order to analyze the microstructure and solidification properties of the amorphous alloys produced by example 1 and comparison example 1, an optical microscope, SEM, X-ray diffractometer and TEM were used. Also, in order to analyze thermal characteristics of amorphous transitions, crystallization behaviors and so forth, Differential Scanning Calorimetry (DSC), Differential Thermal Analysis (DTA) and so forth were used. Herein, heating rate was set to 0.667 K/s and 0.333 K/s, respectively. Also, in order to analyze mechanical properties of amorphous phase and amorphous matrix composite materials produced, uniaxial compression test at rate of $10^{-4}s^{-1}$ was conducted to a rod specimen with 1 mm of diameter and 2 mm of length, and a fracture face thereof was monitored by SEM.

Results from the various tests were provided in FIGS. 1 to 7.

FIG. 1 is a photograph showing an end face of a specimen with 1 mm of diameter of $Cu_{57}Zr_{28.5}Ti_{9.5}Ta_5$ amorphous matrix composite materials produced by example 1. As shown in FIG. 1, it can be known that crystal grains of below 10 μm were homogeneously dispersed around the matrix, producing composite material.

Figure 2:
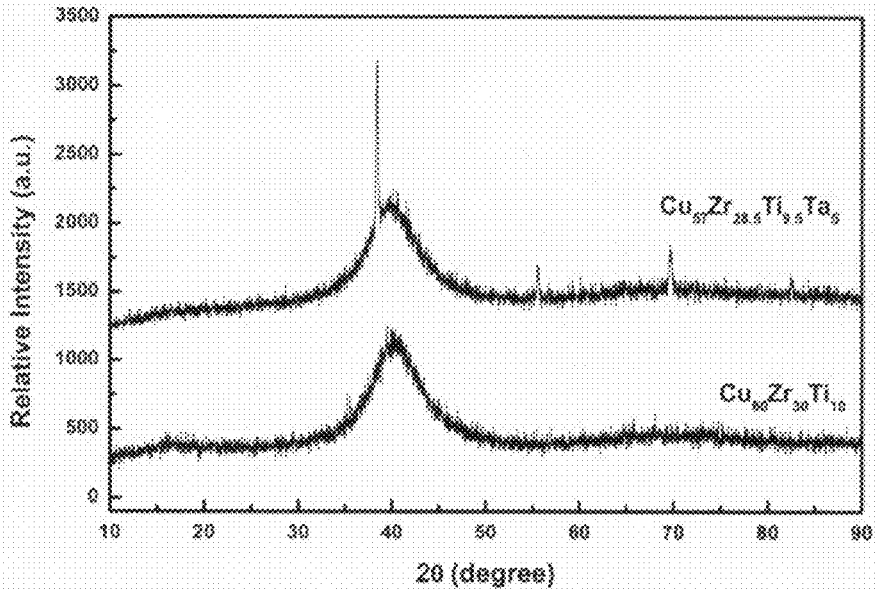
FIG. 2 is an X-ray diffractometer graph of Cu—Zr—Ti—Ta amorphous matrix composite materials produced by the present invention and of Cu—Zr—Ti amorphous materials of the prior art.

FIG. 2 is an X-ray diffractometer graph of $Cu_{57}Zr_{28.5}Ti_{9.5}Ta_5$ amorphous matrix composite materials produced by example 1 and of $Cu_{60}Zr_{30}Ti_{10}$ amorphous materials of comparison example 1. Herein, x-axis is diffraction degree 2θ and y-axis is relative intensity.

As shown in FIG. 2, $Cu_{60}Zr_{30}Ti_{10}$ amorphous material of the prior art had diffraction pattern of typical amorphous materials with 2θ range of about 15°. Comparing with this, $Cu_{57}Zr_{28.5}Ti_{9.5}Ta_5$ amorphous matrix composite materials of the present invention had diffraction pattern of amorphous material together with Ta solid solution peak of Body Center Cubic (BCC) structure.

Figure 3A:
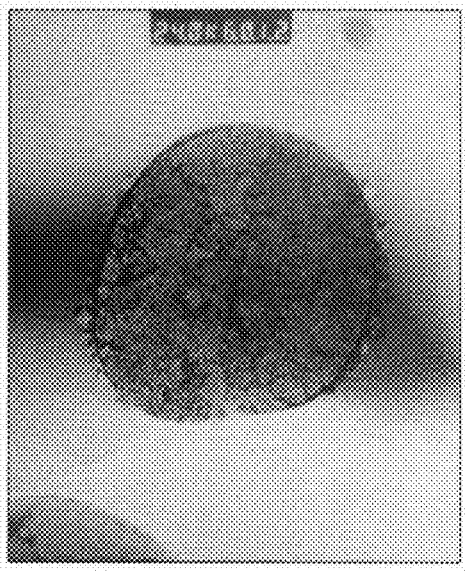
FIGS. 3*a* to 3*c* are micropliotographs by transmission electron microscopic (TEM) for Cu—Zr—Ti—Ta amorphous matrix composite materials produced by the present invention.
Figure 3B:
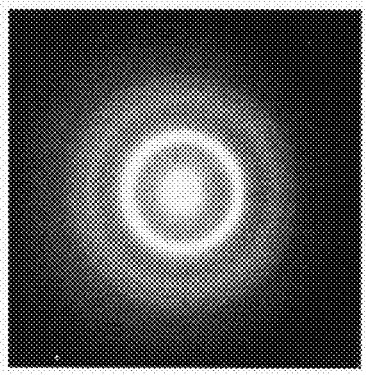
Figure 3C:
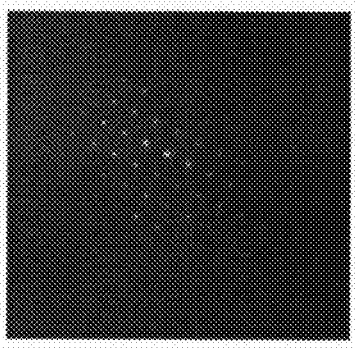

FIGS. 3*a* to 3*c* are bright field image and selected area diffraction pattern of microphotographs by transmission electron microscopic (TEM) for $Cu_{57}Zr_{28.5}Ti_{9.5}Ta_5$ amorphous matrix composite materials produced by example 1. Bright field image showed that the matrix and crystal grains existed. Particularly, selected area diffraction pattern showed that the matrix was amorphous and the crystal grains were BCC.

Figure 4:
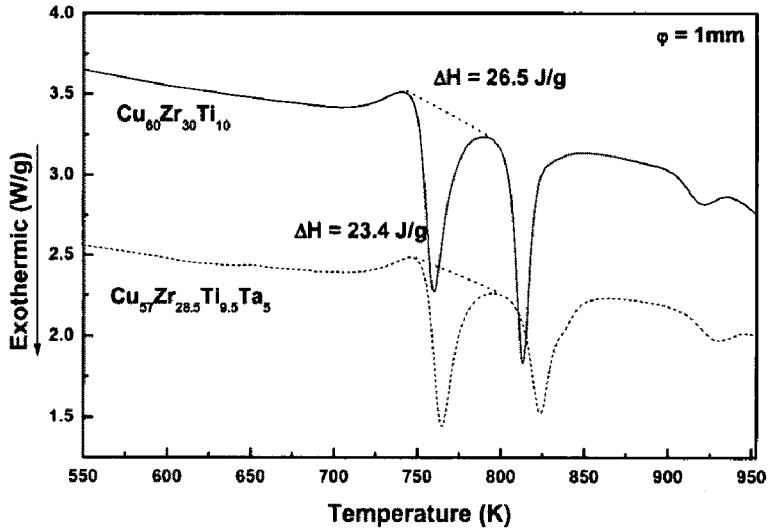
FIG. 4 is a Differential Scanning Calorimetry (DSC) graph of Cu—Zr—Ti—Ta amorphous matrix composite materials produced by the present invention and of Cu—Zr—Ti amorphous materials of the prior art.

Accordingly, as shown in FIGS. 2 and 3, it was known that the Cu-based amorphous matrix composite material of the present invention was provided in which the matrix was amorphous and the crystal grains were Ta solid solution in BCC, FIG. 4 is a Differential Scanning Calorimetry (DSC) graph showing the results of thermal analysis of $Cu_{60}Zr_{30}Ti_{10}$ of amorphous materials of the prior art and of $Cu_{57}Zr_{28.5}Ti_{9.5}Ta_5$ amorphous matrix composite materials produced by example 1. The results were shown in Table 1. In FIG. 4, x-axis indicates temperature K and y-axis indicates exothermic W/g.

TABLE 1

| Composition | $T_g$(K) | $T_{x1}$(K)<br>$\Delta H_1$(J/g) | $T_{x2}$(K)<br>$\Delta H_2$(J/g) | $T_{x3}$(K)<br>$\Delta H_3$(J/g) |
|---|---|---|---|---|
| $Cu_{60}Zr_{30}Ti_{10}$ | 729 | 751<br>−26.4 | 805<br>−24.8 | 901<br>−2.8 |
| $Cu_{57}Zr_{28.5}Ti_{9.5}Ta_5$ | 733 | 755<br>−22.5 | 812<br>−19.5 | 909<br>−3.1 |

As shown in FIG. 4 and Table 1, it can be known that thermal behaviors of $Cu_{60}Zr_{30}Ti_{10}$ amorphous material and $Cu_{57}Zr_{28.5}Ti_{9.5}Ta_5$ amorphous matrix composite material were similar each other. Heating values at first crystallization behavior of $Cu_{60}Zr_{30}Ti_{10}$ amorphous material and $Cu_{57}Zr_{28.5}Ti_{9.5}Ta_5$ amorphous matrix composite material were 26.5 J/g and 23.4 J/g, respectively, so that heating value of composite material was corresponding to about 88% of that of amorphous material. According to the result, it can be known that composite materials of the present invention were amorphous matrix composite materials containing about 10% of crystal grains.

Figure 5:
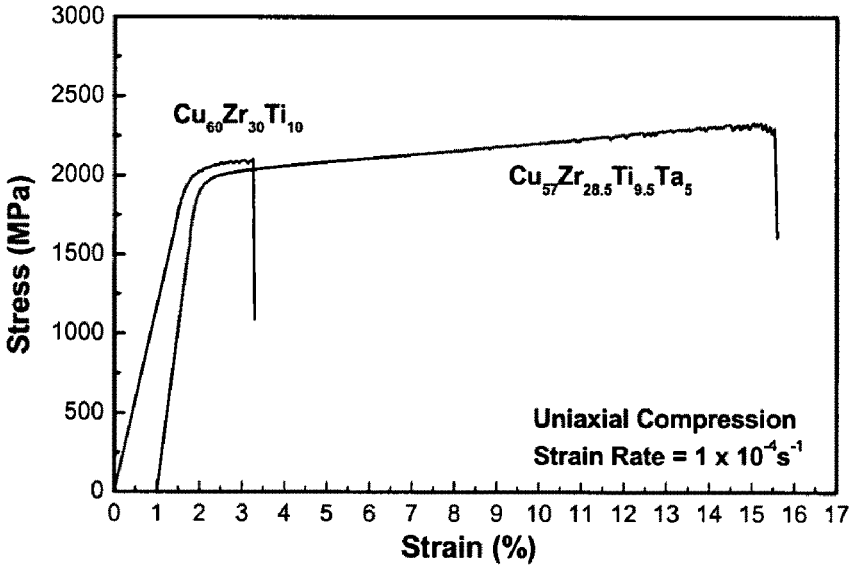
FIG. 5 is a stress-strain curve for Cu—Zr—Ti—Ta amorphous matrix composite materials produced by the present invention and for Cu—Zr—Ti amorphous materials of the prior art.

FIG. 5 is a stress-strain curve for $Cu_{60}Zr_{30}Ti_{10}$ of amorphous material of the prior art and $Cu_{57}Zr_{28.5}Ti_{9.5}Ta_5$ amorphous matrix composite material produced by example 1. Herein, x-axis indicates strain % and y-axis indicates stress MPa.

As shown in FIG. 5, $Cu_{60}Zr_{30}Ti_{10}$ amorphous material indicated that elongation rate was about 3.5% and strength was 2100 MPa, and $Cu_{57}Zr_{28.5}Ti_{9.5}Ta_5$ amorphous matrix composite material indicated that elongation rate was about 14.5% and strength was 2300 MPa.

That is to say, amorphous matrix materials produced by the present invention improved in strength by about 200 MPa compared with prior amorphous materials, together with considerable improvement in ductility.

Figure 6A:
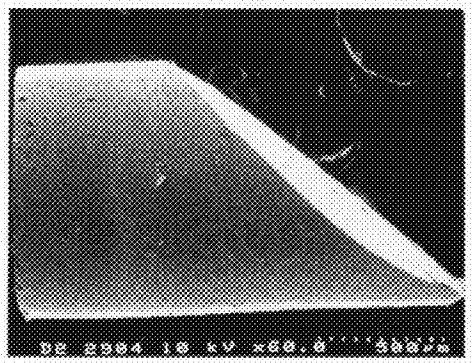
FIGS. 6*a* to 6*c* are photographs of Scanning Electron Microscopic (SEM) for fracture face and shear bands of a specimen of the prior Cu—Zr—Ti amorphous materials after fractured.
Figure 6B:
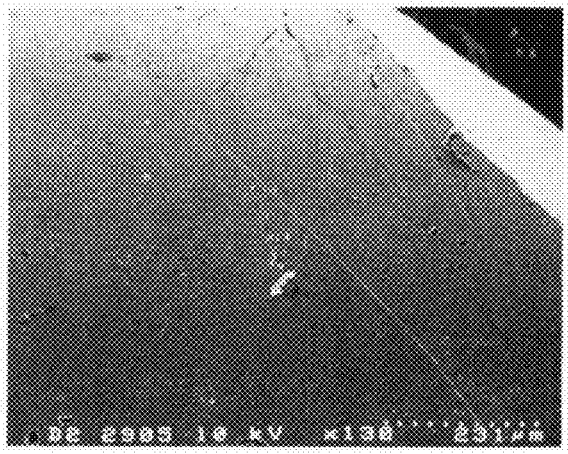
Figure 6C:
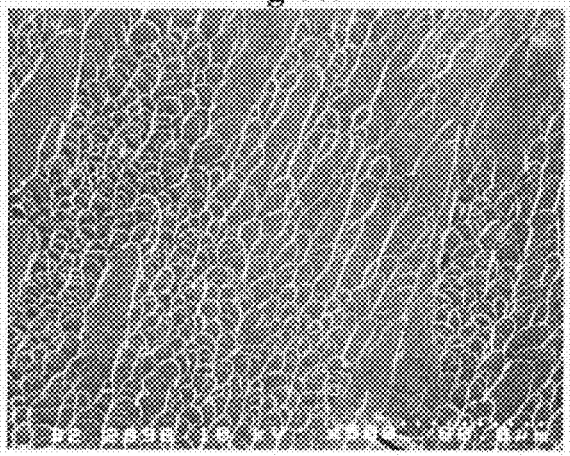

FIGS. 6*a* to 6*c* are photographs of Scanning Electron Microscopic (SEM) for fracture face and shear bands of the prior $Cu_{60}Zr_{30}Ti_{10}$ amorphous material after fractured. The fracture was proceeded in an angle of about 45 degrees relative to maximum shear stress direction. The fracture face was vein pattern typically generated in amorphous materials and had plural shear bands.

Figure 7A:
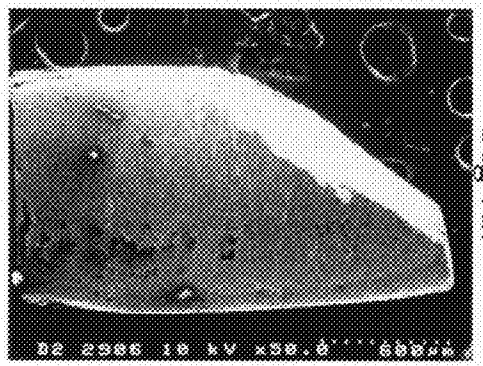
FIGS. 7*a* to 7*c* are photographs of Scanning Electron Microscopic (SEM) for fracture face and shear bands of a specimen of Cu—Zr—Ti—Ta amorphous matrix composite materials of the present invention after fractured.
Figure 7B:
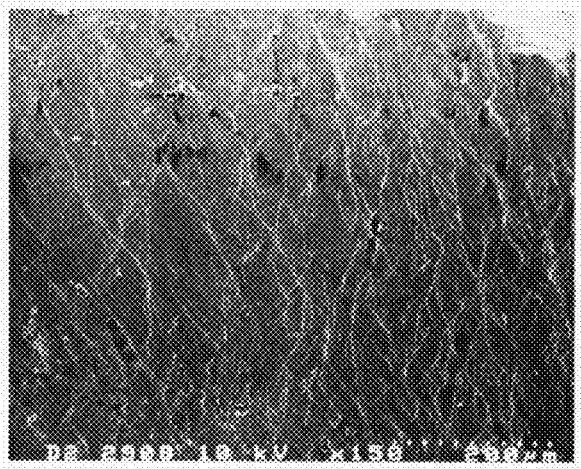
Figure 7C:
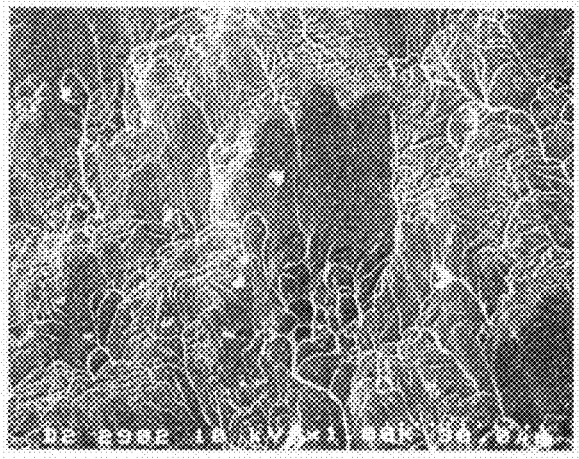

FIGS. 7*a* to 7*c* are photographs of Scanning Electron Microscopic (SEM) for fracture face and shear bands of $Cu_{57}Zr_{28.5}Ti_{9.5}Ta_5$ amorphous matrix composite material produced by example 1 after fractured. As was in amorphous material, the fracture was proceeded in an angle of about 45° relative to maximum shear stress direction. The fracture face was vein pattern typically generated in amorphous materials.

Also, it can be known that while amorphous material of the prior art indicated about 3.5% of elongation rate due to fracture proceeded by plural shear bands, amorphous matrix composite material of the present invention indicated about 14.5% of improved elongation rate due to fracture proceeded by very many shear bands as shown in FIG. 7.

As shown in the embodiment, Cu-based amorphous matrix composite materials of the present invention have excellent strength and elongation rate comparing with common amorphous materials by adding high fusion point element(s) such as Ta and/or W, etc. Consequently, since Cu-based amorphous matrix composite materials of the present invention can prevent abrupt fracture behaviors generated in amorphous materials, they can be utilized in various industrial applications as structural materials requiring high strength and ductility.

As described above, Cu-based amorphous matrix composite materials of the present invention can minimize strength reduction of bulk type amorphous materials, considerably increase elongation rate that is known to be a drawback in amorphous materials, and provide excellent mechnical properties at room temperature, by adding high fusion point element such as Ta and/or W, etc.

Cu-based amorphous matrix composite materials of the present invention have excellent strength, wear resistance and corrosion resistance, so that they can be widely utilized in an area of machine parts having problems in wear and corrosion. For example, they can be widely adapted to a mid to high temperature light alloy used in rockets and air crafts for the military and to wear resistant alloy used in a transportation equipment for land, sea and air.

Also, Cu-based amorphous matrix composite materials containing high fusion point element of the present invention can be produced by economical mass production and effectively substitute for existing crystalline metallic materials, creating new industry, which provides wide applications and excellent ripple effect.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A method for producing composite materials comprising a Cu-based amorphous alloy and high fusion point element(s) comprising:

(a) melting high fusion point element(s) selected from a group consisting of Ta and W together with Zr as a matrix element, to produce a binary master alloy; and (b) remelting the binary alloy obtained from the step (a) together with Cu, Zr and Ti as matrix element(s), to produce another master alloy with target composition.

2. The method for producing composite materials comprising a Cu-based amorphous alloy and high fusion point element(s) as claimed in claim 1, wherein the target composition of the master alloy in the step (b) satisfies the following Chemical formula 1;

$$Cu_aZr_bTi_cR_d \qquad \text{[Chemical formula 1]}$$

where R is Ta, W or combination thereof, a, b, c and d are atomic weight ratio, a+b+c+d equals 100, a, b, c and d have the range of $45 \leqq a \leqq 65$, $10 \leqq b \leqq 35$, $5 \leqq c \leqq 30$ and $5 \leqq d \leqq 10$, respectively.

3. The method for producing Cu-based amorphous matrix composite materials containing high fusion point element as claimed in claim 1 further comprising:

(c) melting the master alloy of the step (b) in the atmosphere of Ar in a Quartz tube using a radio-frequency melting furnace; and (d) injecting the melted alloy of the step (c) into a molding die with blowing Ar gas, and solidifying the same.

* * * * *